US007542583B2

(12) United States Patent
Funahashi

(10) Patent No.: US 7,542,583 B2
(45) Date of Patent: Jun. 2, 2009

(54) LOUDSPEAKER

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 517 days.

(21) Appl. No.: 10/549,424

(22) PCT Filed: Feb. 22, 2005

(86) PCT No.: PCT/JP2005/002751

§ 371 (c)(1),
(2), (4) Date: Sep. 15, 2005

(87) PCT Pub. No.: WO2005/086530

PCT Pub. Date: Sep. 15, 2005

(65) Prior Publication Data

US 2006/0245615 A1 Nov. 2, 2006

(30) Foreign Application Priority Data

Mar. 8, 2004 (JP) ..... 2004-063525

(51) Int. Cl.
*H04R 1/00* (2006.01)
*H04R 9/06* (2006.01)
*H04R 7/20* (2006.01)

(52) U.S. Cl. ..... 381/398; 381/404; 181/172

(58) Field of Classification Search ..... 381/403, 381/404, 398; 181/166, 171, 172
See application file for complete search history.

(56) References Cited

U.S. PATENT DOCUMENTS

2002/0051558 A1* 5/2002 Kuze et al. ..... 381/404
2003/0185415 A1* 10/2003 Funahashi et al. ..... 381/398
2004/0165746 A1* 8/2004 Kreitmeier et al. ..... 381/398
2004/0218778 A1* 11/2004 Weisman ..... 381/396

OTHER PUBLICATIONS

English translation of Search Report Form PCA/ISA/210, Jun. 7, 2005 (from WIPO).

* cited by examiner

*Primary Examiner*—Curtis Kuntz
*Assistant Examiner*—Jesse A Elbin
(74) *Attorney, Agent, or Firm*—RatnerPrestia

(57) ABSTRACT

A loudspeaker has a configuration in which edge diameter in the cross section of second edge coupled to suspension holder is set to be larger than edge diameter in the cross section of first edge coupled to diaphragm. With such a configuration, a loudspeaker with reduced harmonic distortion is provided.

5 Claims, 5 Drawing Sheets

LOUDSPEAKER

This application is a U.S. national phase application of PCT international applicaton PCT/JP/2005/002751.

TECHNICAL FIELD

The present invention relates to a loudspeaker.

BACKGROUND ART

FIG. 5 is a sectional view showing a conventional loudspeaker. As shown in FIG. 5, a conventional loudspeaker has a structure in which voice coil unit 2 that is slidably disposed on magnetic circuit 1 is coupled to the inner circumferential end of diaphragm 3, the outer circumferential end of diaphragm 3 is coupled to frame 5 via first edge 4, and furthermore, the rear surface of diaphragm 3 is coupled to frame 5 via suspension holder 6 and second edge 7. In this structure, since first edge 4 and second edge 7 are symmetric to each other, harmonic distortion of a loudspeaker is reduced and power linearity is improved. Information of prior art document relating to the invention of this application is disclosed in, for example, Japanese Patent Unexamined Publication No. 2004-7335.

In such a loudspeaker, however, the outer diameter of second edge 7 contained in frame 5 is inevitably smaller than that of first edge 4 provided in an open part of frame 5. Therefore, it has been difficult to perfectly equalize the upper and lower amplitudes of diaphragm 3, thus making it difficult to completely suppress the harmonic distortion of a loudspeaker.

SUMMARY OF THE INVENTION

The object of the present invention is to reduce harmonic distortion further by solving the above-mentioned problem with a prior art.

In order to achieve the above-mentioned object, a loudspeaker of the present invention has a configuration in which the edge diameter in the cross section of a second edge coupled to a suspension holder is set to be larger than the edge diameter in the cross section of a first edge coupled to a diaphragm.

With such a configuration, the difference between the compliance by the second edge and the compliance by the first edge can be excluded, and the harmonic distortion of a loudspeaker can be further reduced.

BRIEF DESCRIPTION OF THE DRAWINGS

*Fig.* 1A is a sectional view showing a loudspeaker in accordance with an exemplary embodiment of the present invention.

REFERENCE MARKS IN THE DRAWINGS

Figure 1A:
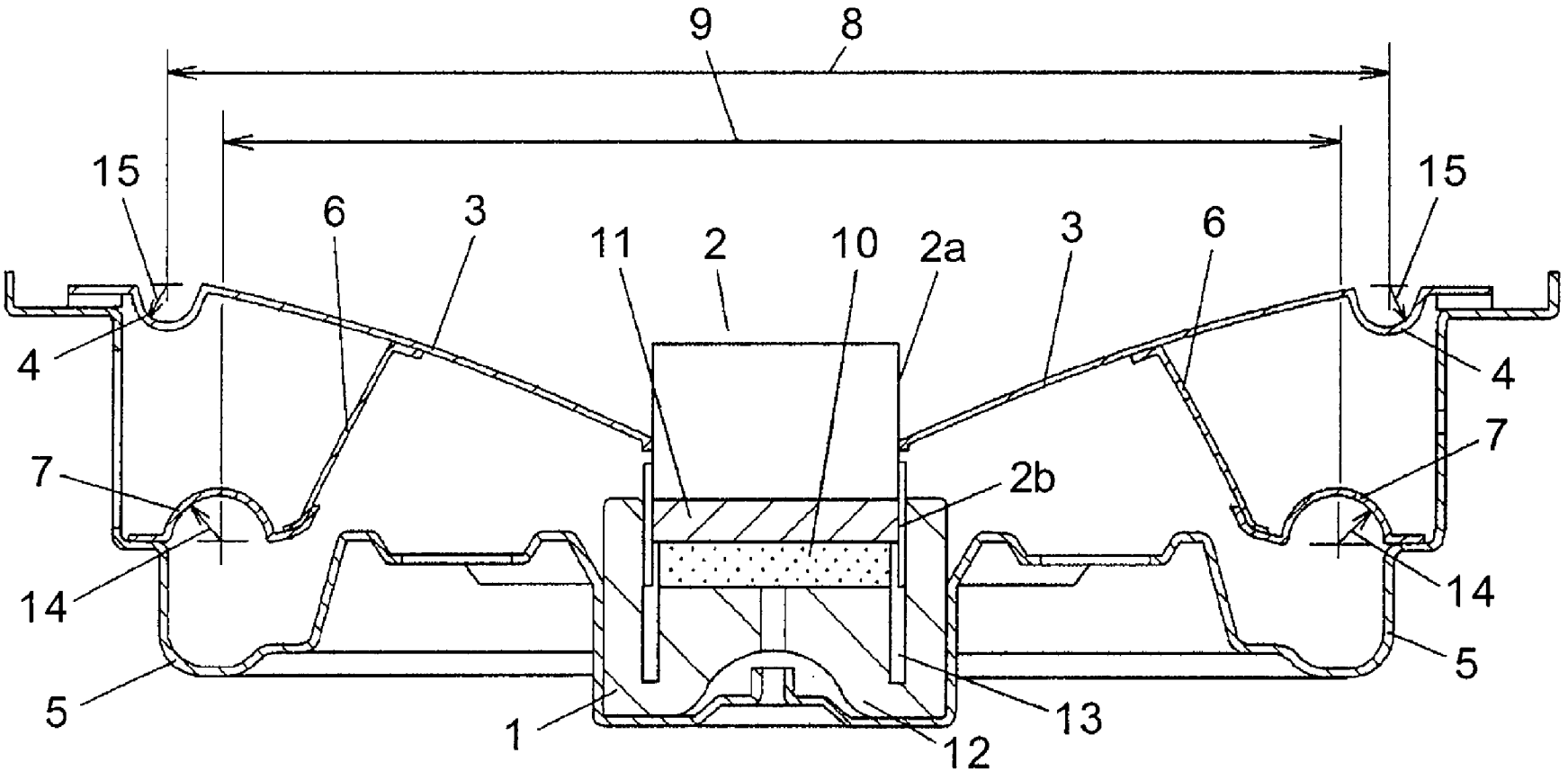
FIG. 1B is a sectional view showing a loudspeaker in accordance with an exemplary embodiment of the present invention.

1 magnetic circuit
2 voice coil unit
3 diaphragm
4 first edge
5 frame
6 suspension holder
7 second edge
13 magnetic gap
14, 15 edge diameter

DETAILED DESCRIPTION OF THE PREFERRED EMBODIMENTS

Exemplary Embodiment

Hereinafter, an exemplary embodiment of the present invention is described with reference to drawings. In the description, the same reference numbers refer to the same configurations described above as a background art.

*Fig.* 1A is a sectional view showing a loudspeaker in accordance with an exemplary embodiment of the present invention. Magnetic circuit 1 disposed in the middle of the bottom part of frame 5 is constructed by combining and adhesively bonding magnet 10, plate 11 and yoke 12. Magnetic circuit 1 is provided with magnetic gap 13 opening toward the upper side of the loudspeaker. Voice coil unit 2 has a structure including cylindrical main body 2*a* and coil 2*b* wound around the outer circumferential part of main body 2*a* and is disposed slidably with respect to magnetic gap 13, in which the sliding allows the amplitude of diaphragm 3. Diaphragm 3 is coupled to the upper part of voice coil unit 2 at its inner circumferential end part and to the opening part of frame 5 at its outer circumferential end part via first edge 4. Furthermore, the bottom surface side of diaphragm 3 is coupled to frame 5 via suspension holder 6 and second edge 7.

In the thus configured loudspeaker, the power point for sliding voice coil unit 2 is allowed to exist inside a region surrounded by first edge 4 and second edge 7, which are coupled to frame 5. Thereby, diaphragm 3, suspension holder 6 and voice coil unit 2 are regarded as one solid body, and therefore, rolling of voice coil unit 2 is suppressed. Furthermore, since the bending direction of first edge 4 that supports diaphragm 3 and the bending direction of second edge 7 that supports suspension holder 6 are symmetric to each other, action of canceling the nonlinearity in the respective directions of vibration occurs, thus enabling harmonic components generated in diaphragm 3 to be attenuated.

However, since first edge 4 is coupled to the open end side of frame 5 and attached to the outer circumferential end of diaphragm 3 having a larger outer circumference diameter, and second edge 7 is coupled to the bottom surface side of frame 5 and attached to the outer circumferential end of suspension holder 6 having a smaller outer circumference diameter, the difference in the compliance for supporting the rigid body consisting of diaphragm 3, suspension holder 6 and voice coil unit 2 occurs between in first edge 4 and second edge 7.

Therefore, in the loudspeaker according to the present invention, in order to exclude this difference, edge diameter 14 in the cross section of second edge 7 is set to be larger than edge diameter 15 of first edge 4.

Figure 2:
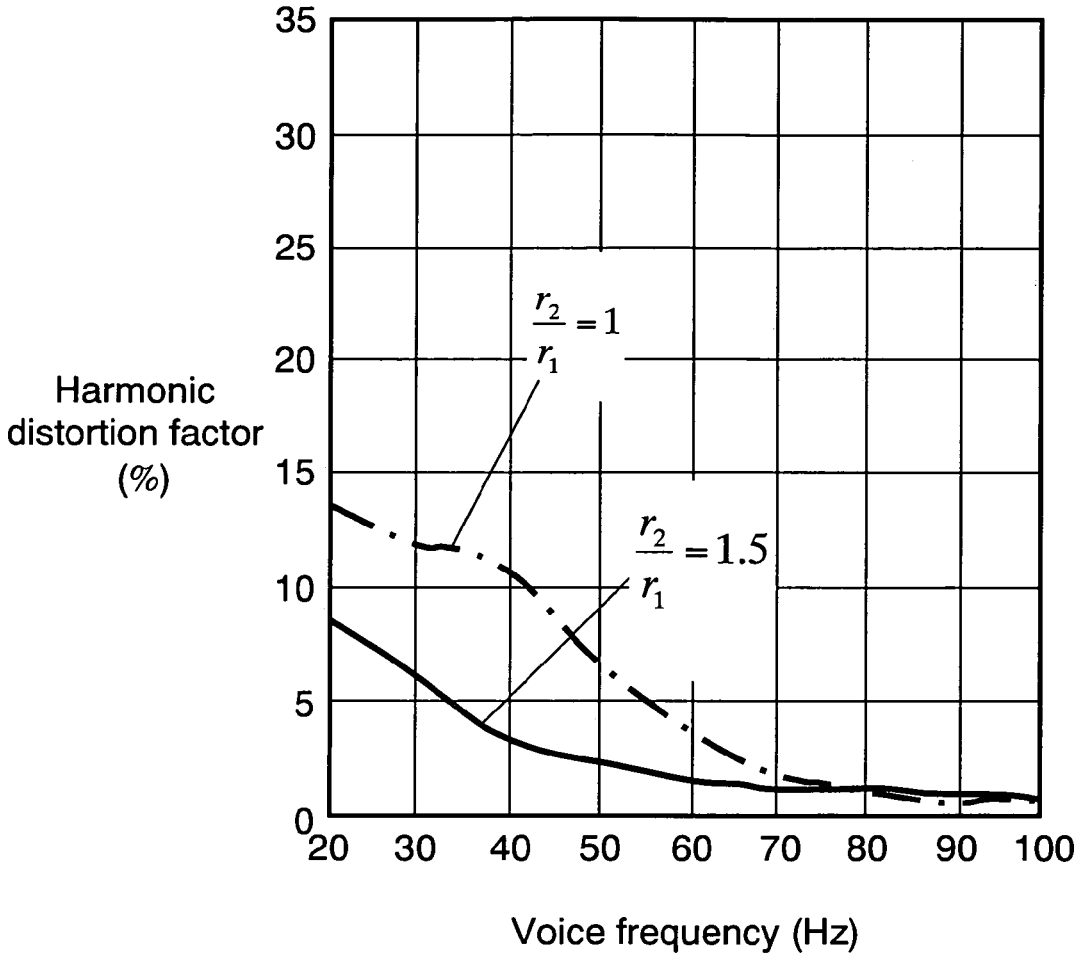
FIG. 2 is a graph to show the improvement of harmonic distortion factor of a loudspeaker in accordance with an exemplary embodiment of the present invention.

FIG. 2 is a graph to show the improvement of the harmonic distortion factor of a loudspeaker in accordance with an exemplary embodiment of the present invention, which is obtained from experiment results. In FIG. 2, the abscissa shows the voice frequency from the loudspeaker and the ordinate shows the harmonic distortion factor of the loudspeaker.

When the value r1 of edge diameter 15 is equal to the value r2 of edge diameter 14 (r2/r1=1), a harmonic distortion factor property as shown by a dashed line in FIG. 2 is obtained. The graph shows that in the low frequency range from 20 Hz to 40 Hz, the harmonic distortion factor of the loudspeaker is more than 10% and the reproducibility of sound is damaged.

When the value r2 of edge diameter 14 is set to be larger than the value r1 of edge diameter 15 (r2/r1=1.5), a harmonic distortion factor property as shown by a solid line in FIG. 2 was obtained. At this time, even in the voice frequency in the range of about 20 Hz, the harmonic distortion factor of the loudspeaker can be suppressed to less than 10%. Furthermore, in the voice frequency range of about 35 Hz or more, the harmonic distortion factor of the loudspeaker can be reduced to as low as less than 5%.

By setting the values as mentioned above, the increase in the compliance of second edge 7 because of outer circumference diameter 9 being small is suppressed. Then, the difference in the compliance between first edge 4 and second edge 7, which couple the rigid body consisting of diaphragm 3, suspension holder 6 and voice coil unit 2 to frame 5, is excluded, and thus the harmonic distortion of the loudspeaker is further reduced. In particular, the harmonic distortion factor in the low frequency range is suppressed and the reproducibility of sound of the loudspeaker is improved.

Figure 1B:
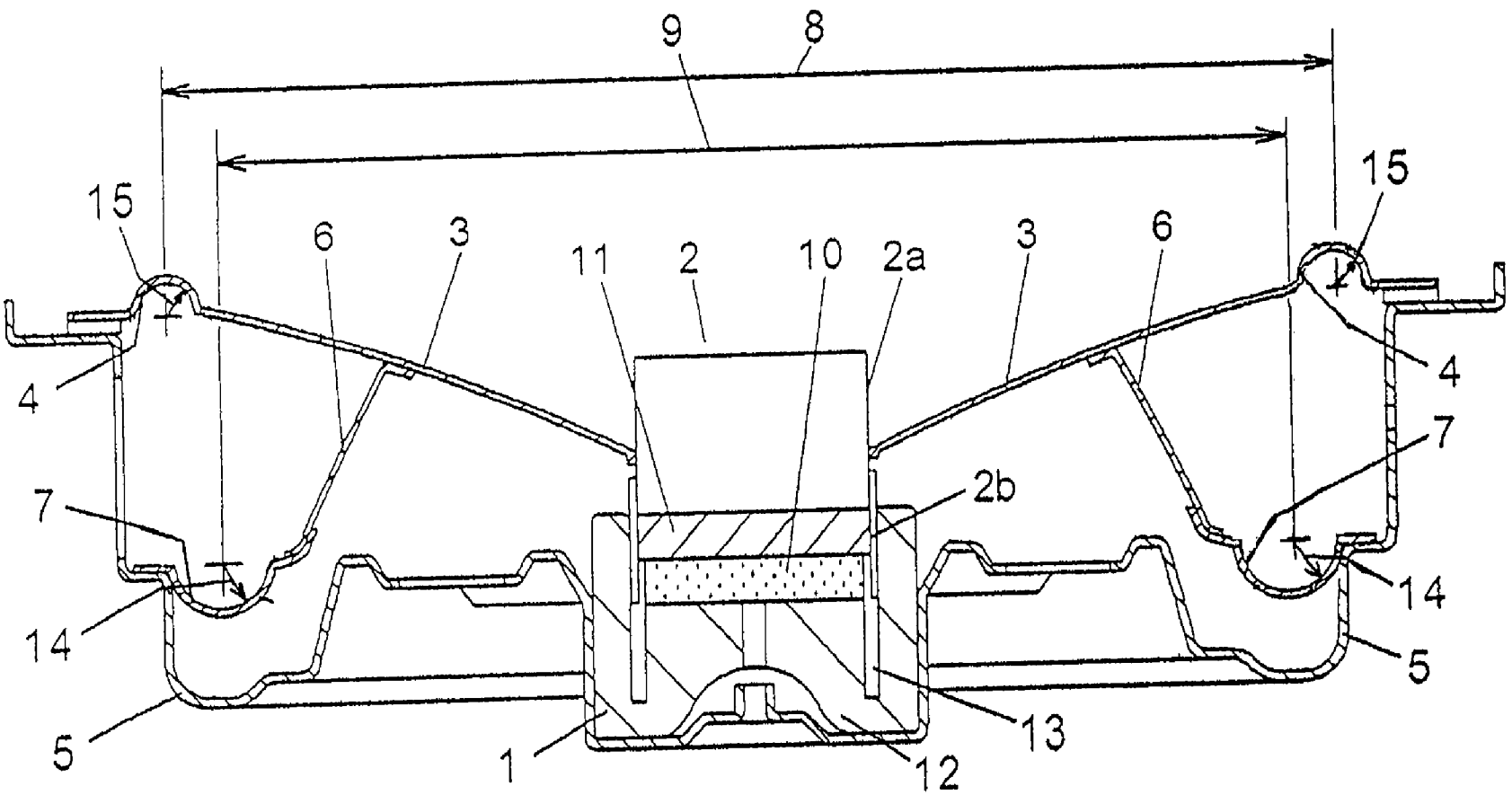

Furthermore, in the structure shown in FIG. 1, first edge 4 bends downward and second edge 7 bends upward. With this structure, first edge 4 can be prevented from protruding from the upper end side of frame 5, thus downsizing the loudspeaker itself. Although not shown, when first edge 4 bends upward and second edge 7 bends downward, the distance between the fulcrums of first edge 4 seen from diaphragm and the fulcrum of second edge 7 seen from suspension holder 6 is substantially increased, thus enabling the rolling of voice coil unit 2 to be suppressed further.

Figure 3:
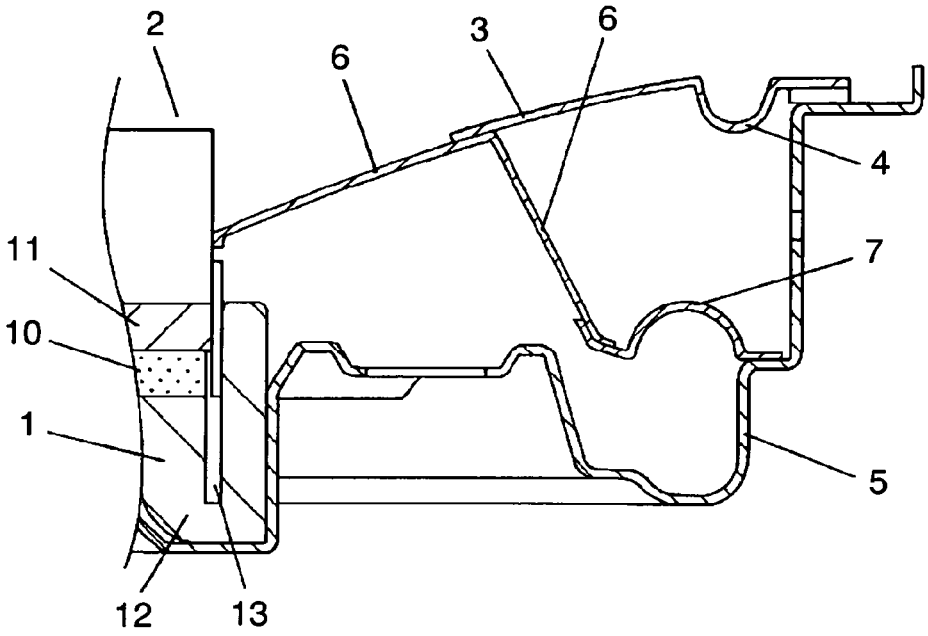
FIG. 3 is a sectional view showing a structure of attachment of a diaphragm in another exemplary embodiment.
Figure 4:
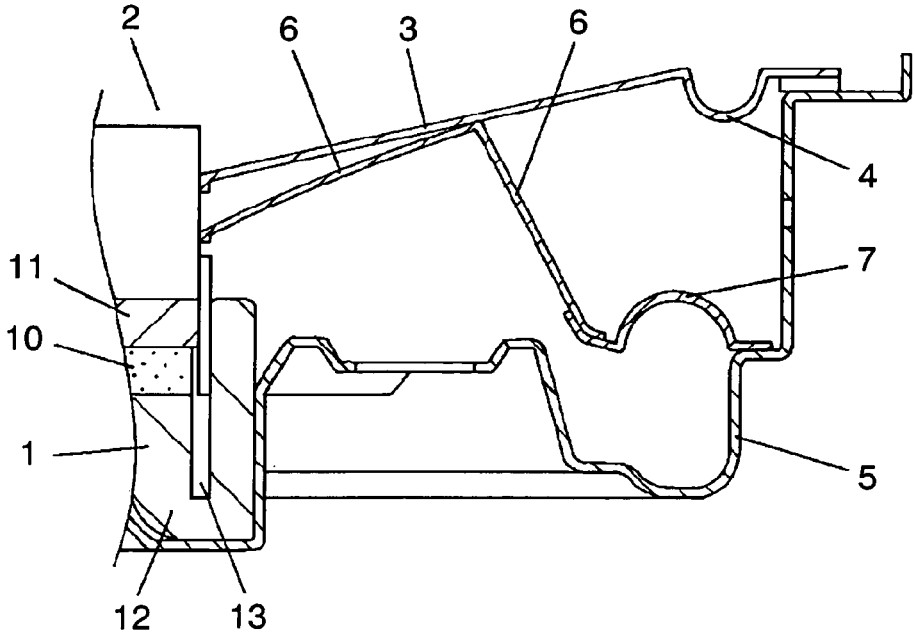
FIG. 4 is a sectional view showing a structure of attachment of a diaphragm in a further exemplary embodiment.
Figure 5:
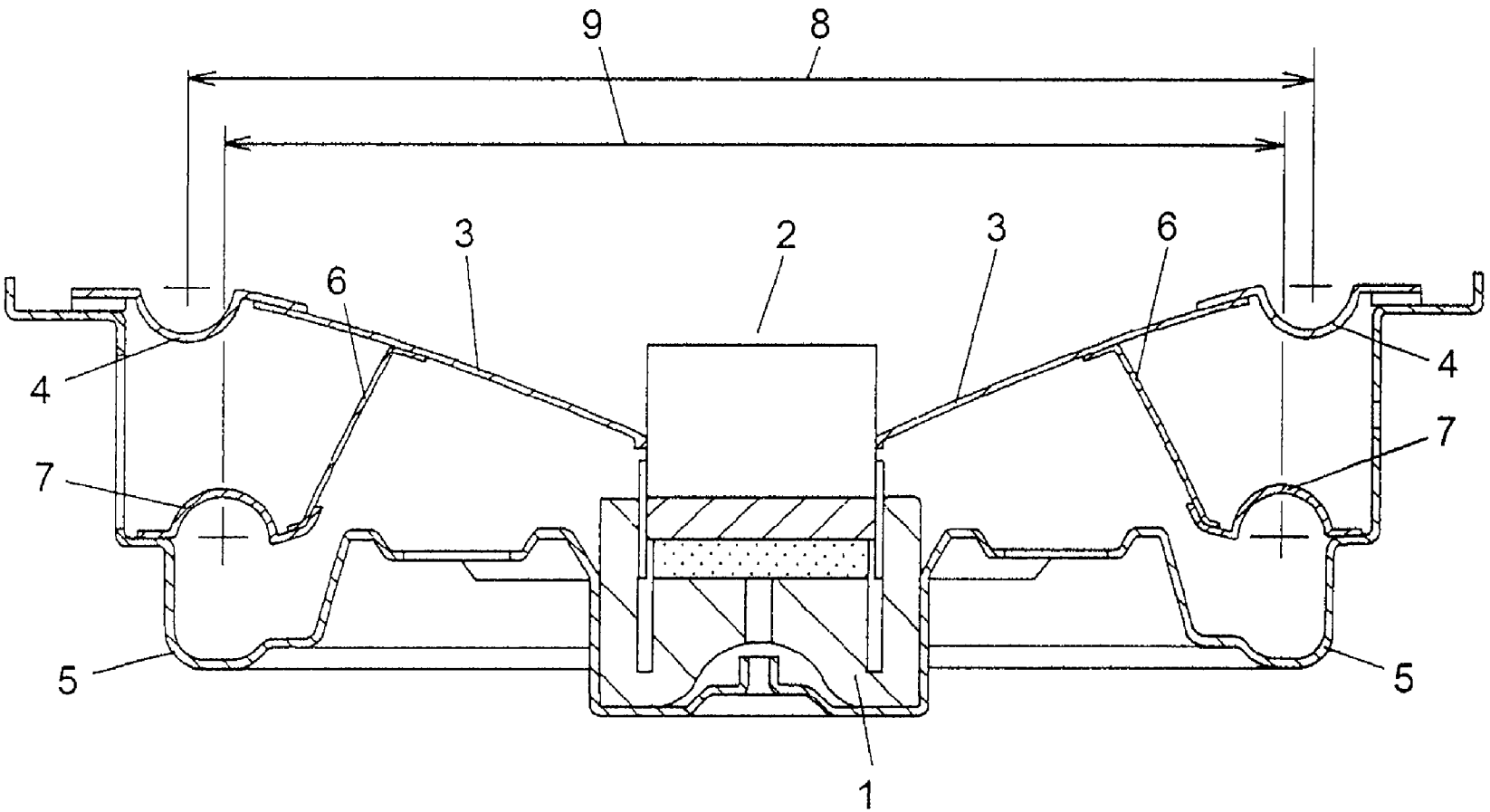
FIG. 5 PRIOR ART
FIG. 5 is a sectional view showing a conventional loudspeaker.

In the configuration shown in FIG 1A, diaphragm 3 is directly coupled to voice coil unit 2. However, as shown in FIG. 3, an inner circumferential part of suspension holder 6 is further extended from a connection point between suspension holder 6 and diaphragm 3, and diaphragm 3 may be indirectly coupled to voice coil unit 2 via this extended part. Furthermore, as shown in FIG. 4, diaphragm 3 and the inner circumferential end of suspension holder 6 may be coupled to voice coil unit 2, respectively.

INDUSTRIAL APPLICABILITY

The present invention is effective in a loudspeaker that requires the reduction in harmonic distortion and is particularly useful to loudspeakers for automobile use.

The invention claimed is:

1. A loudspeaker comprising:

a frame;

a magnetic circuit disposed inside the frame;

a voice coil unit disposed slidably with respect to a magnetic gap provided in the magnetic circuit;

a diaphragm coupled to the voice coil unit at its inner circumferential end part and to the frame at its outer circumferential end part via a first edge; and a suspension holder coupled to a rear surface of the diaphragm and coupled to the frame at its one end via a second edge;

wherein an edge diameter in a cross section of the second edge is set to be larger than an edge diameter in a cross section of the first edge, and wherein a ratio of the edge diameter of the second edge to the edge diameter of the first edge is in a range of greater than 1.0 and less than or equal to 1.5.

2. The loudspeaker according to claim 1, wherein the first edge is allowed to bend downward and the second edge is allowed to bend upward.

3. The loudspeaker according to claim 1, wherein the first edge is allowed to bend upward and the second edge is allowed to bend downward.

4. A loudspeaker according to claim 1, wherein the voice coil unit, diaphragm and suspension holder act as a single solid body to suppress rolling of the voice coil unit.

5. A loudspeaker comprising:

a frame;

a voice coil unit disposed slidably with respect to the frame;

a diaphragm coupled to the voice coil unit at its inner circumferential end part and to the frame at its outer circumferential end part via a first edge; and a suspension holder coupled to one side of the diaphragm and coupled to the frame at its one end via a second edge, wherein a ratio of the edge diameter of the second edge to the edge diameter of the first edge is in a range of greater than 1.0 and less than or equal to 1.5.

* * * * *